United States Patent [19]

Putman et al.

[11] Patent Number: 4,856,272

[45] Date of Patent: Aug. 15, 1989

[54] METHOD FOR MAINTAINING BLADE TIP CLEARANCE

[75] Inventors: Robert L. Putman, Palm City, Fla.; Edward J. Hovan, Manchester, Conn.

[73] Assignee: United Technologies Corporation, Hartford, Conn.

[21] Appl. No.: 189,270

[22] Filed: May 2, 1988

[51] Int. Cl.[4] ..... F02C 7/12

[52] U.S. Cl. ..... 60/39.02; 60/39.15; 60/39.75; 415/116; 415/178

[58] Field of Search ..... 60/39.02, 39.15, 39.29, 60/39.75; 415/115, 116, 175, 178

[56] References Cited

U.S. PATENT DOCUMENTS

| | | | |
|---|---|---|---|
| 4,019,320 | 4/1977 | Redinger et al. | 60/39.75 |
| 4,069,662 | 1/1978 | Redinger, Jr. et al. | 60/226 R |
| 4,213,296 | 7/1980 | Schwarz | 60/39.75 |
| 4,304,093 | 12/1981 | Schulze | 60/39.75 |
| 4,363,599 | 12/1982 | Cline et al. | 415/178 |
| 4,487,016 | 12/1984 | Schwarz et al. | 60/39.75 |
| 4,648,241 | 3/1987 | Putman et al. | 60/39.29 |

FOREIGN PATENT DOCUMENTS

| | | |
|---|---|---|
| 1248198 | 9/1971 | United Kingdom . |

*Primary Examiner*—Louis J. Casaregola
*Attorney, Agent, or Firm*—Troxell K. Snyder

[57] ABSTRACT

A method for periodically restoring the blade tip to annular seal clearance in a gas turbine engine (10) includes incrementing (42*a*, 42*b*) the flow of external cooling air responsive only to an accumulated engine use parameter (58).

5 Claims, 2 Drawing Sheets

METHOD FOR MAINTAINING BLADE TIP CLEARANCE

FIELD OF THE INVENTION

The present invention relates to a method for maintaining blade tip clearance in a gas turbine engine.

BACKGROUND OF THE INVENTION

One of the major contributing factors to the deterioration of specific fuel consumption of aircraft gas turbine engines is the gradual increase in the clearance between the rotor blade tips and the surrounding, non-rotating annular seal ring. As will be appreciated by those skilled in the art, increased clearance between the rotating and stationary components increases the leakage of the working fluid of the engine across individual rotor stages in either the compressor or turbine sections. Such leakage reduces overall engine efficiency hence raising the total specific fuel consumption.

This increase is directly related to the accumulated usage of an engine since the most recent seal installation and/or replacement. The blade tip clearance, and hence sealing effectiveness, are at a minimum immediately following installation, and deteriorate as the engine experiences extended running time and/or repeated use cycles. Eventually the deterioration of the blade tip clearance reaches a sufficient level so as to economically warrant replacement of the worn components, a time consuming and expensive task.

Methods of improving both the wear life and effectiveness of blade tip seals have long been sought by engine designers. One effective method, termed "active clearance control" recognizes that one principal source of seal wear is the differential thermal growth of the rotor and surrounding engine casing which supports the annular seal ring. Active clearance control, as disclosed in U.S. Pat. No. 4,069,662, uses a modulated flow of cool air derived from the engine bypass airflow stream and exhausted adjacent the high pressure turbine casing to shrink the casing relative to the high pressure turbine blade tips under steady state, high altitude cruise conditions. By providing such a modulated flow of cooling air at preselected engine operating conditions, active clearance control allows the engine to operate with minimum seal clearance for the majority of its operating cycle while reducing or eliminating the interference or abrasion between the seal ring and blade tips which can occur during transient conditions such as takeoff, throttle back, etc.

Although a major advance in the art of seal effectiveness and efficient gas turbine engine operation, engines equipped with active clearance control are still subject to accumulated, engine usage related blade tip clearance deterioration. It is known to attempt to measure the current blade tip clearance in an operating engine for the purpose of modifying such clearance by either mechanical or thermal means, however such measuring methods have not proved as accurate and dependable as would be required in an operating aircraft environment.

What is required is a method for maintaining or restoring optimum blade tip clearance in an aircraft gas turbine engine between scheduled periodic seal replacement.

DISCLOSURE OF THE INVENTION

It is therefore an object of the present invention to provide a method for restoring deteriorated blade tip clearance in a gas turbine engine.

It is further an object of the present invention to provide a clearance restoring method which may be implemented between scheduled periodic replacement of the blade tips and/or annular seal.

It is further an object of the present invention to provide a clearance restoring method which may be implemented during scheduled service of a gas turbine engine in the field and which does not require highly accurate measurement of the current blade tip clearance in a particular engine.

It is still further an object of the present invention to provide a method, based upon the accumulated level of engine usage, which may be applied to a particular engine and which is responsive only to the level of accumulated engine usage of the particular engine.

According to the present invention, a method for counteracting the deterioration of the clearance between the runner blade tips and the surrounding annular seal members in a gas turbine engine is provided. The method establishes an incremental change in the engine's active clearance control system at a predetermined engine usage interval between scheduled overhauls. The increment and usage interval are predetermined from prior experience with a plurality of similarly configured engines, allowing the adjustment to a particular engine to be made based solely on the accumulated hours or cycles of engine operation.

Specifically, the method is applicable to a gas turbine engine wherein a flow of gas, independent of the engine working fluid, is delivered adjacent a portion of the engine structure for influencing the clearance between the rotating blade tips and the surrounding annular seal. The temperature of the delivered air is significantly different from the equilibrium temperature of the engine portion and the flow rate of the gas is modulated based upon current engine operating conditions. The delivered gas thus heats or cools the engine portion for causing thermal expansion or contraction of the structure as required to maintain optimum tip clearance over the engine operating range.

The method according to the present invention reduces the overall deterioration of the blade tip clearance resulting from extended engine operation following seal installation or replacement by incrementally changing the baseline gas flow rate at a predetermined level of accumulated engine usage. The usage level and size of the incremental gas flow rate adjustment are predetermined by establishing schedules of the variation of blade tip clearance relative to accumulated engine usage and gas flow rate for a plurality of similar engines. Once such schedules are established, a particular engine is restored to the seal clearance which existed immediately after the previous overhaul by increasing or decreasing the baseline gas flow rate sufficient to shrink or expand the appropriate engine structure by an amount equivalent to the predicted amount of seal deterioration.

Even more specifically, for a gas turbine engine active clearance control system wherein a modulated flow of relatively cool fan or bypass air is directed so as to impinge on the exterior of the high pressure turbine casing so as to reduce the diameter thereof, at least during high altitude cruise conditions, the present invention provides a method for maintaining the operating tip clearances by incrementally increasing the baseline impinging airflow rate at least once between scheduled seal replacement. The increased baseline flow reduces the deteriorated seal clearance by further shrinking the turbine casing, substantially restoring turbine efficiency to the level in existence immediately after the most recent seal replacement.

The present invention provides restored seal clearance and engine efficiency without complicated field measurements and individual engine analysis. By adjusting the baseline gas flow in each engine at one or more interim periods, preferably corresponding to other scheduled engine maintenance, the method according to the present invention achieves the desired restoration quickly and easily with a minimum of individual analysis and the accompanying cost and potential for error.

Both these and other objects and advantages of the method according to the present invention will be apparent to those skilled in the art upon review of the following specification and the appended claims and drawing figures.

DETAILED DESCRIPTION OF THE PREFERRED EMBODIMENT

Figure 1:
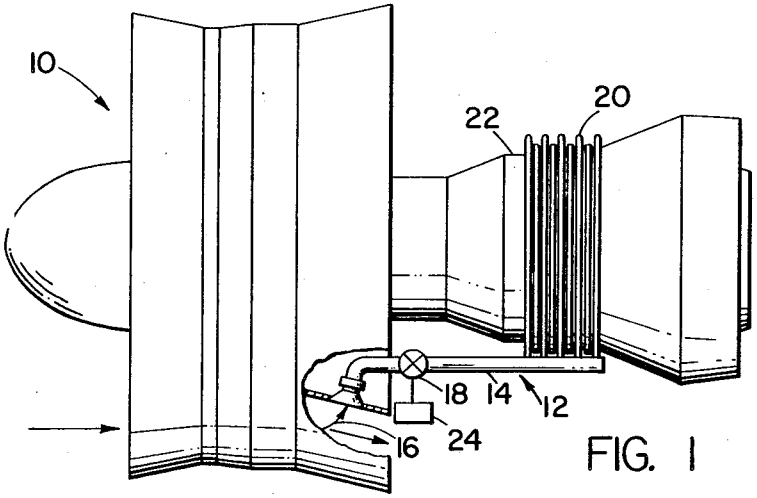
FIG. 1 shows a schematic representation of a typical turbofan gas turbine engine having an active clearance control.

Referring to FIG. 1, a gas turbine engine 10 is provided with an active clearance control system 12 having a conduit 14 for conducting a flow of relatively cool gas, such as the bypass or fan air 16 through a modulating valve 18 and into one or more discharge manifolds 20 disposed circumferentially about the engine high pressure turbine section 22. The cool air 16 discharged from the manifolds 20 impinges on the turbine case 22, shrinking the turbine case radially, depending upon the flow rate of the relatively cool gas, thereby reducing the blade tip clearance in the engine 10.

As discussed hereinabove, the flow rate of the cool gas 16 is modulated by a control system 24 responsive to current engine operating parameters such as the power level, barometric pressure, altitude, etc. As also described in the preceding Background section, an active clearance control as shown in FIG. 1 functions during engine operation at high altitude, cruise conditions to shrink the turbine casing such that the clearance between the rotating turbine blade tips and the surrounding, case mounted, annular seal is at a practical minimum. The modulating valve reduces the flow of cooling air during engine transient operation, allowing the case to assume a hotter, equilibrium temperature which opens the clearance between the blade tip and annular seal for avoiding interference and premature seal wear during such transient operation. That such open seals incur penalties in specific fuel consumption is well known, but acceptable due both to the relatively short portion of the engine operating cycle for such transient operation and the significant reduction in premature seal wear achieved.

Figure 2:
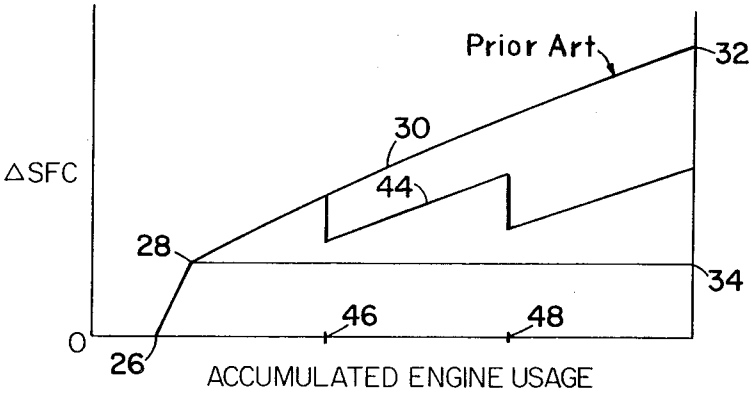
FIG. 2 shows a comparison of the change in specific fuel consumption versus accumulated engine usage between a prior art engine arrangement and an engine utilizing the clearance restoring method according to the present invention.

Active clearance control equipped engines nonetheless experience a gradual seal deterioration as engine usage is accumulated. FIG. 2 shows a graphical representation of the change in specific fuel consumption plotted against accumulated engine usage. Point 26 on this graph represents the test stand specific fuel consumption as established for an individual engine prior to shipment from the factory to the customer. Point 28 represents the baseline, as-installed engine specific fuel consumption which is slightly increased relative to the test stand value 26. As engine usage accumulates, the change in specific fuel consumption rises 30 eventually reaching a point 32 which justifies an engine overhaul and seal replacement, resulting in a return to a specific fuel consumption level 34 approximately equal to that of the newly installed engine 28.

For the purpose of this discussion, an "engine seal overhaul" is defined as repair or replacement of the blade tips and/or annular seals, effectively resulting in a new combination of sealing elements within the gas turbine engine. The term "accumulated engine usage" is meant herein as defining an engine wear parameter responsive to one or more operation-related values such as the total accumulated hours of engine running time, and/or the total engine flight cycles since the last overhaul. Of the named values, the number of flight cycles, each including periods of runway idle, takeoff, climb, cruise, flight idle, and taxi, for example, is preferred as being most related to the rate of blade tip seal clearance deterioration.

As can be appreciated by observing the specific fuel consumption curve 30 of FIG. 2, the deterioration of seal clearance and accompanying increase in engine specific fuel consumption between seal replacement can impose a significant fuel and cost penalty on the engine operator. More frequent seal replacement merely trades the fuel related penalty for a parts and labor related cost penalty.

Figure 3A:
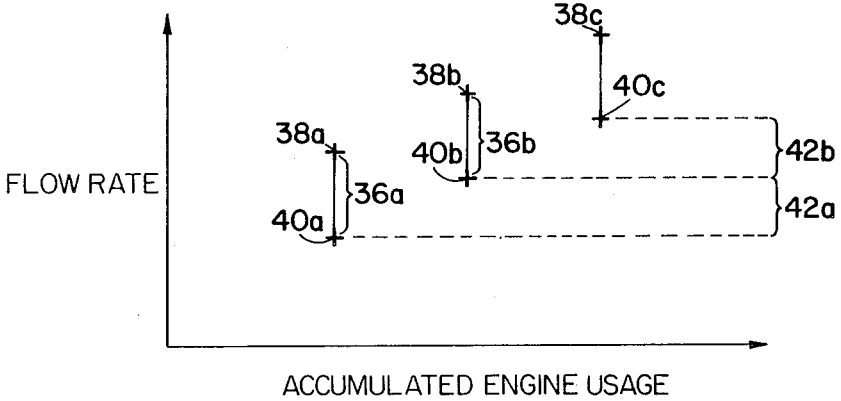
FIG. 3*a* shows the change in baseline gas flow rate and modulated flow range between seal installation according to the present invention.

The method according to the present invention recognizes the gradual deterioration 30 of both engine specific fuel consumption and blade tip clearance, correcting such deterioration by incrementing the baseline flow of the relatively cool gas 16 at least once between sequential seal overhauls. FIG. 3*a* shows the range 36*a* of gas flow between maximum cruise 38*a* and the baseline flow rate 40*a* for a new or newly overhauled engine. After a significant period of accumulated engine usage wherein the blade tip clearance and specific fuel consumption have deteriorated, the method according to the present invention augments the baseline flow rate upward as represented by 40*b*, increasing the range 36*b* a like amount over the range of engine operating conditions.

Figure 3B:
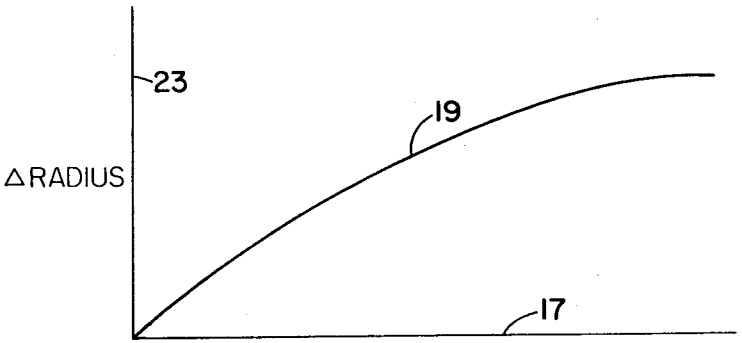
FIG. 3*b* shows the influence of cool gas flow rate on the inner diameter of a high pressure turbine case.

Depending upon the particular model of engine, clearance deterioration, and other factors, the baseline flow may be incremented again 40*c* to again reduce the clearance between the blade tip and annular seal across the engine operating range. The increments 42*a*, 42*b* are derived from test measurement of the radial shrinkage 23 of the turbine case 22 in response to changing mass flow 17 of the cooling gas as shown in the curve 19 in FIG. 3*b*. By averaging the rate of measured seal clearance deterioration in a plurality of similar engines for a particular engine model or family, it is possible to establish a schedule of corrective incremental changes in the baseline gas flow at corresponding intervals of accumulated engine usage.

The effect of such incremental adjustments in the baseline gas flow is apparent from the jagged curve 44 of FIG. 2 which represents the change in specific fuel consumption for an engine utilizing a clearance restoring method according to the present invention between subsequent seal overhauls. For a particular engine achieving an accumulated engine usage 46, the method according to the present invention provides an incremental change 42*a* to the baseline gas flow rate which cools the turbine case 22 additionally over the engine operating range thus improving both seal clearance and total specific fuel consumption as shown in FIG. 2. An additional baseline flow increment 42*b* may be provided at usage level 48 to again reduce the seal clearance across the engine operating range and again restore the specific fuel consumption to substantially the baseline level 28.

It should be apparent to those skilled in the art that the savings in fuel consumption resulting from the use of the method according to the present invention is represented by that portion of FIG. 2 lying between curves 30 and 44. This area represents the reduction in specific fuel consumption between a prior art engine in which the blade tip clearance deteriorates steadily between seal overhauls, and an engine according to the present invention wherein the deteriorated tip clearance is restored at least once by incrementing the flow rate of exterior turbine cooling air.

Such incrementing of cooling air is not open ended. The diversion of a portion of the bypass fan air or other relatively cool gas from the engine incurs a cycle penalty which increases with increasing gas diversion. The diversion penalty is of course small relative to the efficiency benefits resulting from the use of the active clearance control, however diversion of more and more cool gas for turbine case cooling does reduce the overall system benefit. Thus, although restoring blade tip clearance and specific fuel consumption subsequent to an overhaul, the method according to the present invention does not eliminate the need of the engine for such periodic seal servicing.

Figure 4:
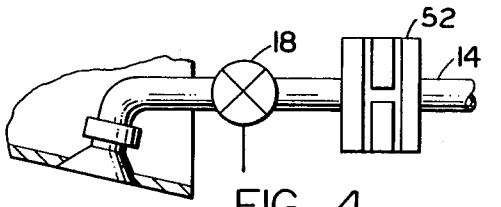
FIG. 4 shows a means for achieving incremented gas flow rate.
Figure 5:
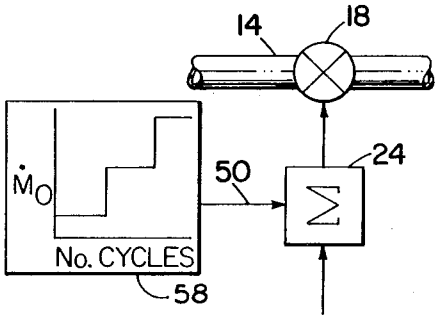
FIG. 5 shows an alternative means for achieving incremented flow rates according to the present invention.

The incremental change of the baseline gas flow rate may be achieved by several means such as are shown in FIGS. 4 and 5. FIG. 4 provides a sized orifice 52 in the conduit 14. At one or more interim service intervals between seal overhauls, the orifice 46 may be replaced by a standardized, differently sized orifice which increments the baseline gas flow as established for that particular model or family of engines. The simplicity of the orifice means should be readily apparent, being itself a component mounted on the exterior of the engine and out of the flow of the working fluid.

FIG. 5 uses the already existing gas flow modulating valve 18 by providing a scheduled input 58 wherein the accumulated engine usage varies the input setpoint 50 to the valve controller 24. The engine control system may thus itself increment the baseline gas flow rate based upon the accumulated engine usage without the need to mechanically change orifices or the like.

The number of interim adjustments made to the baseline gas flow rate may vary depending upon the economic cost of such incremental changes as well as the rate of deterioration of the blade tip seals. For an engine having a ten mil (0.25 mm) seal clearance deterioration over 4,000 engine cycles, one interim change at 2,000 engine cycles would produce a five mil (0.13 mm) restoration and reduce the accumulated specific fuel consumption penalty resulting from such deterioration by as much as 35% between consecutive overhaul periods.

The present invention is thus well suited to obtain the objects and advantages as set forth hereinabove. It will be further appreciated that the method and means discussed hereinabove are not meant as being exhaustive of all potential embodiments of the method according to the present invention which is limited only by the scope of the claims presented hereinafter.

We claim:

1. A method for maintaining long term performance efficiency between consecutive periodic seal replacement in a particular one of a plurality of substantially similar gas turbine engines each having an active clearance control system for selectably reducing the clearance between a plurality of rotating blade tips and a surrounding annular seal, including means, disposed adjacent a portion of the engine structure, for delivering a modulated flow of gas, said gas flow having a temperature substantially different from the engine portion, means, responsive to current engine operating conditions, for modulating the flow rate of the delivered gas relative to a baseline flow rate, the baseline flow rate being established at each seal replacement, wherein the method comprises the steps of:

establishing, for the plurality of engines, an average clearance deterioration rate between the blade tips and the annular seal, the deterioration rate being determined as a function of accumulated engine usage since the most recent overhaul, selecting at least one level of accumulated engine operation intermediate two consecutive periodic seal replacements and determining, for the selected level, an average incremental change to the gas baseline flow rate required to restore the deteriorated clearance between the blade tips and the annular seal, the restored clearance being no less than the undeteriorated clearance immediately following seal replacement, and altering, by an amount equal to the average incremental change, the baseline gas flow rate of the particular one engine when the particular one engine achieves the selected level of accumulated engine usage.

2. The method as recited in claim 1, wherein the level of accumulated engine usage in the plurality of gas turbine engines is determined responsive to the number of engine operating cycles since the most recent seal replacement.

3. The method as recited in claim 1, wherein the portion of the engine structure is an annular engine case and wherein the modulated gas is relatively cool with respect to the engine case, and wherein the step of altering the baseline gas flow rate includes the step of:

augmenting the baseline gas flow rate of the relatively cool engine.

4. The method as recited in claim 1, further comprising the step of:

coordinating the step of alternating the baseline gas flow rate so as to coincide with a scheduled interim engine maintenance operation.

5. The method as recited in claim 1, wherein the step of determining the average incremental change to the gas baseline flow rate includes the step of:

determining the dimensional change of the portion of the engine structure responsive to changes in gas flow rate, and selecting the appropriate incremental gas flow rate change so as to dimensionally change the engine structure by an amount substantially equal to the average clearance deterioration corresponding to the selected level of accumulated engine usage.

* * * * *